US009090949B2

(12) United States Patent
Kellezi et al.

(10) Patent No.: US 9,090,949 B2
(45) Date of Patent: Jul. 28, 2015

(54) METHOD FOR THE PRODUCTION OF TOOLS MADE OF ALLOYED STEEL AND TOOLS IN PARTICULAR FOR THE CHIP-REMOVING MACHINING OF METALS

(75) Inventors: Gert Kellezi, Leoben (AT); Devrim Caliskanoglu, Giessen (AT); Andreas Baernthaler, St. Marein i.M. (AT)

(73) Assignee: BOEHLER EDELSTAHL GMBH & CO. KG, Kapfenberg (AT)

( * ) Notice: Subject to any disclaimer, the term of this patent is extended or adjusted under 35 U.S.C. 154(b) by 954 days.

(21) Appl. No.: 13/274,961

(22) Filed: Oct. 17, 2011

(65) Prior Publication Data

US 2012/0093679 A1 Apr. 19, 2012

(30) Foreign Application Priority Data

Oct. 18, 2010 (AT) ..... 1732/2010

(51) Int. Cl.

| | |
|---|---|
| ***C22C 38/30*** | (2006.01) |
| ***C22C 38/06*** | (2006.01) |
| ***C22C 30/00*** | (2006.01) |
| ***C22C 38/22*** | (2006.01) |
| ***B22D 27/00*** | (2006.01) |
| ***C21D 8/00*** | (2006.01) |
| ***C21D 1/25*** | (2006.01) |
| ***B22D 7/00*** | (2006.01) |
| ***C21D 6/00*** | (2006.01) |
| ***C22C 38/24*** | (2006.01) |

(52) U.S. Cl.

CPC .. *C21D 1/25* (2013.01); *B22D 7/00* (2013.01); *C21D 6/002* (2013.01); *C22C 38/22* (2013.01); *C22C 38/24* (2013.01); *C21D 2211/004* (2013.01)

(58) Field of Classification Search

CPC ..... B07D 7/00; C22C 38/24; C21D 6/002; C21D 2211/004

See application file for complete search history.

(56) References Cited

U.S. PATENT DOCUMENTS

| | | | |
|---|---|---|---|
| 5,458,703 | A | 10/1995 | Nakai |
| 6,200,528 | B1 | 3/2001 | Rodney et al. |
| 7,655,101 | B2 | 2/2010 | Putzgruber et al. |
| 2006/0180249 | A1 | 8/2006 | Ozaki |

FOREIGN PATENT DOCUMENTS

| | | |
|---|---|---|
| EP | 1997921 | 12/2008 |
| GB | 2 096 171 A | 10/1982 |
| JP | 8325673 | 12/1996 |

OTHER PUBLICATIONS

Austrian Search Report that issued with respect to Austrian Patent Application No. AT20100001732, issue date of report Oct. 18, 2010.

*Primary Examiner* — Jessee Roe

(74) *Attorney, Agent, or Firm* — Greenblum & Bernstein, P.L.C.

(57) ABSTRACT

The invention relates to a method for the production of tools for a chip-removing machining of metallic materials and to a tool with improved wear resistance and/or high toughness. The invention further provides an alloyed steel with a chemical composition comprising carbon, silicon, manganese, chromium, molybdenum, tungsten, vanadium, and cobalt as well as aluminum, nitrogen, and iron. The alloyed steel may be used to make tools to a hardness of greater than 66 HRC and increased chip-removing machining performance.

12 Claims, 3 Drawing Sheets

S630B,

S630B,

S630C,

S630C,

S630D,

S630D,

METHOD FOR THE PRODUCTION OF TOOLS MADE OF ALLOYED STEEL AND TOOLS IN PARTICULAR FOR THE CHIP-REMOVING MACHINING OF METALS

CROSS-REFERENCE TO RELATED APPLICATIONS

The present application claims priority under 35 U.S.C. §119 of Austrian Patent Application No. A 1732/2010, filed on Oct. 18, 2010, the disclosure of which is expressly incorporated by reference herein in its entirety.

BACKGROUND OF THE INVENTION

1. Field of the Invention

The invention relates to a method for the production of tools for a chip-removing machining of metallic materials.

Furthermore, the invention relates to chip-removing tools.

2. Discussion of Background Information

Tools made of alloyed steel, in particular high-speed steel, with a chemical composition in % by weight of

| | |
|---|---|
| Carbon (C) | 0.7 to 1.3 |
| Silicon (Si) | 0.1 to 1.0 |
| Manganese (Mn) | 0.1 to 1.0 |
| Chromium (Cr) | 3.5 to 5.0 |
| Molybdenum (Mo) | 0.1 to 10.0 |
| Tungsten (W) | 0.1 to 19.0 |
| Vanadium (V) | 0.8 to 5.0 |
| Cobalt (Co) | up to 8.0 |

as well as aluminum, nitrogen, iron and impurity elements as remainder, are essentially known.

For example, in GB 2 096 171 A, high-speed steel alloys are proposed having an elemental content of vanadium, tungsten, and molybdenum to exceed a total of 2% by weight, wherein in a further development of the invention, the concentration of silicon plus aluminum is to be adjusted below a maximum value of 3.5% by weight. An advantageous effect on the tool properties is to be achieved by these measures, which effect otherwise appears to be achievable only by means of cobalt.

According to US 2006/0180 249 A1, it has been proposed to alloy a low-alloyed high-speed steel (C=0.5-0.75% by weight, Cr=5.0-6.0% by weight, W=0.5-2.0% by weight, V=0.7-1.75% by weight) with aluminum up to 0.1% by weight and nitrogen up to 0.04% by weight, wherein the Mo equivalent is to be 2.5-5.0% by weight and the Mo equivalent/vanadium content value is to be 2 to 4.

U.S. Pat. No. 6,200,528 B1 discloses a high-speed steel alloyed in a complex manner, which can advantageously be produced with a special oxidation method. This material, which is to have improved high-temperature properties, is alloyed with 0.03 to 1.25% by weight aluminum and has nitrogen contents from above 0.03 to above 0.04% by weight.

Most of the proposed tool steels alloyed with aluminum, in particular the high-speed steels, are not used for production of cutting tools. Although it is true that there are indications that individual specific tool properties can be influenced favorably by aluminum content in the steel (for example, where applicable, aluminum content of up to 2% by weight), a desired quality assurance and an overall high quality profile of the tool do not appear to be present to a sufficient extent or not in a convincing manner. In other words: in modern machining facilities, the tool is exposed simultaneously to a number of stresses, including high mechanical tribological and wear stresses due to the work technologies provided, as well as elevated temperature, wherein a failure in only one type of stress requires tool replacement that is expensive, at least from the point of view of cost effectiveness.

In practical use, tools alloyed with aluminum are used only to a small extent, probably also for reasons of possible uncertain quality.

It is known to the person skilled in the art that aluminum contents in steel strongly cut into the gamma region in the equilibrium diagram.

Carbon in iron/aluminum alloys expands the gamma region. However, the solubility for carbon in γ-mixed crystal is reduced by aluminum.

According to the technical literature, aluminum contents in tool steel can contribute to the fine-grain formation of the material due to nitride precipitations. However, a hardening depth into the piece can be sharply reduced by thermal hardening and tempering treatment.

With high-speed steels, titanium- and/or tantalum- and/or niobium additives are frequently recommended in textbooks in addition to the alloying elements of chromium, tungsten, molybdenum, and vanadium, in order to be able to use a higher hardening temperature in the hardening and tempering of the tool with aluminum and nitrogen, or to minimize its susceptibility to overheating due to coarse grain formation.

According to a large number of expert opinions, aluminum in high-speed steel can only possibly reduce the fretting phenomena on the surface of the tool and have a favorable effect with respect to cratering.

From a comprehensive critical examination of a large number of prior art documents as well as research results, no unambiguously certain indications concerning the effect of aluminum in tool steels can be found. Reasons for a premature failure or a disclosed longer service life of a tool alloyed with aluminum are not known to the person skilled in the art.

General research has shown that as the contents of elements of group 4 and 5 of the periodic table (IUPAC 1988) and carbon rise in tool steel, in particular in high-speed steel, the proportion of monocarbides therein rises and in this way the wear resistance of the tool material can be improved. However, the material toughness is considerably reduced thereby in a disadvantageous manner due to coarse carbide formation, so that the danger of breakage and chipping of the tool is increased.

Moreover, contents of vanadium as an important monocarbide-forming element up to approximately 5% by weight in the presence of elements of group 6 of the periodic table (IUPAC 1988), in particular of molybdenum up to 10% by weight, optionally of tungsten up to 19% by weight and chromium up to 6% by weight in the tool steel, cause only a few hard wear-resistant monocarbides. The chief proportion of carbide in the hardened tool is present essentially as mixed carbides of the $Me_2C$ and $Me_6C$ types, which have a lower abrasion resistance than monocarbides.

SUMMARY OF THE INVENTION

The invention remedies the aforementioned problems and includes a method for producing tools with improved wear resistance and/or higher toughness of the tool material in the hardened and tempered state while avoiding tool damage whose cause frequently cannot be attributed precisely at present by the person skilled in the art.

Also provided are tool materials that in each case, after thermal hardening and tempering, reliably result in improved and excellent qualities in chip-removing tools.

For example, the present invention provides a method for the production of tools for a chip-removing machining of metallic materials, formed from an alloyed steel comprising

| |
|---|
| 0.7 to 1.3% by weight of Carbon (C) |
| 0.1 to 1.0% by weight of Silicon (Si) |
| 0.1 to 1.0% by weight of Manganese (Mn) |
| 3.5 to 5.0% by weight of Chromium (Cr) |
| 0.1 to 10.0% by weight of Molybdenum (Mo) |
| 0.1 to 19.0% by weight of Tungsten (W) |
| 0.8 to 5.0% by weight of Vanadium (V), and |
| up to 8.0% by weight of Cobalt (Co) |

as well as aluminum, nitrogen, and iron, wherein said method comprises:

melting an alloy with the above composition, except for the element aluminum, and heating the alloy to a temperature of 80° C. to 250° C. above the liquidus temperature and deoxidizing the alloy to produce a steel melt;

optionally covering the melt surface with a metallurgically active oxides-dissolving and nitrides-dissolving slag wherein the slag is at least partially melted;

adding 0.4 to 1.4% by weight aluminum into the melt such that the aluminum is distributed homogeneously therein;

stirring the melt so that aluminum nitrides of liquid steel are dissolved in the slag or are adjusted in the steel to a maximum diameter of 38 μm, and the nitrogen content thereof is reduced to below 0.02% by weight;

introducing magnesium into the melt and allowing it to react in the melt;

adjusting the melt to a desired casting temperature, and casting it to produce an ingot;

machining the ingot to produce an object in a desired tool shape;

thermal hardening the shaped tool with a single austenitization at a temperature below 1210° C.;

tempering the shaped tool at a temperature of 500° C. to 600° C.; and chipping the machining allowance of the tool.

In another embodiment, the present invention provides a method as described above, in which the aluminum is at a concentration of 0.4 to 1.3% by weight and is alloyed to the deoxidized melt; and the maximum size of the aluminum nitrides is adjusted to a diameter of 34 μm and a the nitrogen content of the steel is reduced to less than 0.02% by weight.

In another embodiment, the present invention provides a method as described above, wherein magnesium is added to the melt at and/or after alloying with aluminum takes place such that magnesium-rich, nonmetallic inclusions of MgO, MgAlO, MgCaO, Mg(AlCa)O and MgOS having a maximum diameter of 10 μm are formed.

In yet another embodiment, the present invention provides a method as described above, wherein the inclusions have a maximum diameter of 8 μm. The methods as described above may also be performed such that austenitization of the shaped tool occurs at a temperature of 1200° C. with a dwell period thereat of maximum 15 minutes. In another embodiment, the austenitization of the shaped tool may occur at a maximum temperature of 1160° C. with a dwell period thereat of maximum 15 minutes.

The present invention also provides a tool for a chip-removing machining of metallic materials formed from an alloyed steel with a chemical composition comprising:

| |
|---|
| 0.7 to 1.3% by weight of Carbon (C) |
| 0.1 to 1.0% by weight of Silicon (Si) |
| 0.1 to 1.0% by weight of Manganese (Mn) |
| 3.5 to 5.0% by weight of Chromium (Cr) |
| 0.1 to 10.0% by weight of Molybdenum (Mo) |
| 0.1 to 19.0% by weight of Tungsten (W) |
| 0.8 to 5.0% by weight of Vanadium (V) |
| up to 8.0% by weight of Cobalt (Co) |
| 0.4 to 1.4% by weight of Aluminum (Al) |
| 0.001 to 0.02% by weight of Nitrogen (N) |

as well as Iron (Fe) and production-caused impurities, which tool material has a hardness of greater than 66 HRC and a homogeneous distribution of nitrides with a maximum diameter of less than 38 μm as well as magnesium-rich, nonmetallic inclusions of MgO, MgAlO, MgCaO, Mg(AlCa)O and MgOS with a maximum diameter of less than 10 μM.

In another embodiment, the present invention provides such a tool in which the tool material has 0.5 to 1.3% by weight of A1 and/or 0.005 to 0.02% by weight of N, the nitrides with homogeneous distribution have a diameter of less than 34 μm, and the nonmetallic, magnesium-rich inclusions have a maximum diameter of 8 μm or less.

The present invention also provides a tool for the chip-removing machining of metallic materials made by the method described above.

The present invention also provides a method for the production of an ingot formed from an alloyed steel comprising

| |
|---|
| 0.7 to 1.3% by weight of Carbon (C) |
| 0.1 to 1.0% by weight of Silicon (Si) |
| 0.1 to 1.0% by weight of Manganese (Mn) |
| 3.5 to 5.0% by weight of Chromium (Cr) |
| 0.1 to 10.0% by weight of Molybdenum (Mo) |
| 0.1 to 19.0% by weight of Tungsten (W) |
| 0.8 to 5.0% by weight of Vanadium (V), and |
| up to 8.0% by weight of Cobalt (Co) |

as well as aluminum, nitrogen, and iron, wherein said method comprises:

melting an alloy with the above composition, except for the element aluminum, and heating the alloy to a temperature of 80° C. to 250° C. above the liquidus temperature and deoxidizing the alloy to produce a steel melt;

optionally, covering the melt surface with a metallurgically active oxides-dissolving and nitrides-dissolving slag wherein the slag is at least partially melted;

adding 0.4 to 1.4% by weight aluminum into the melt and distributing the aluminum homogeneously therein;

stirring the melt so that aluminum nitrides of liquid steel are dissolved in the slag or are adjusted in the steel to a maximum diameter of 38 μM, and the nitrogen content thereof is reduced to below 0.02% by weight;

introducing magnesium into the melt and allowing the magnesium to react in the melt;

adjusting the melt to a desired casting temperature, and casting the melt to produce an ingot.

In another embodiment, the present invention also provides such a method for producing an ingot, further comprising:

machining the ingot to produce an object in a desired tool shape;

thermal hardening the shaped tool with a single austenitization at a temperature below 1210° C.; and tempering the shaped tool at a temperature of 500° C. to 600° C.

The present invention also provides an ingot produced by such a method.

DETAILED DESCRIPTION OF THE INVENTION

Figure 1:
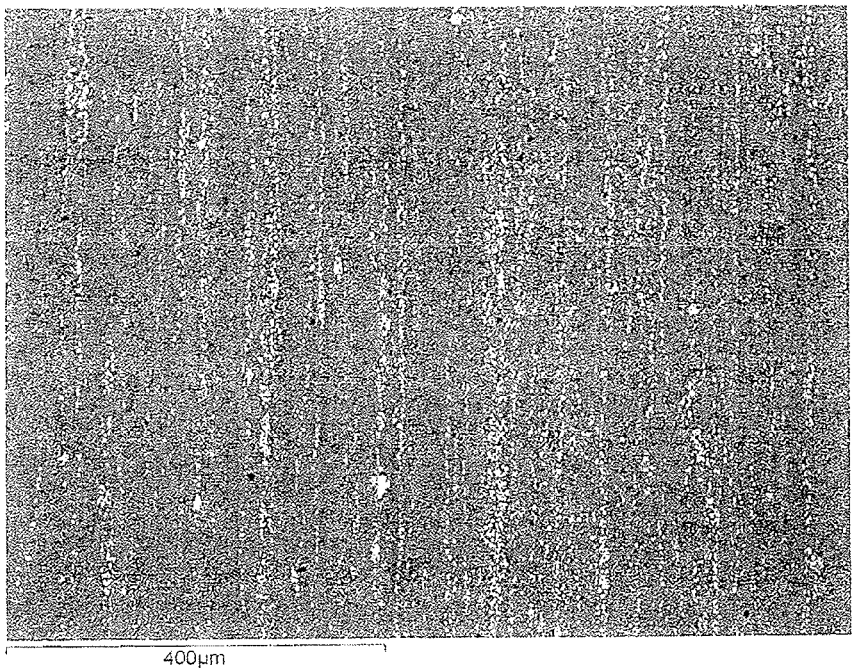
FIG. 1 shows the hardened and tempered alloy S 630 B in an etched micrograph.

The invention provides methods for the production of tools formed from an alloyed steel with a chemical composition comprising

| |
|---|
| 0.7 to 1.3% by weight of Carbon (C) |
| 0.1 to 1.0% by weight of Silicon (Si) |
| 0.1 to 1.0% by weight of Manganese (Mn) |
| 3.5 to 5.0% by weight of Chromium (Cr) |
| 0.1 to 10.0% by weight of Molybdenum (Mo) |
| 0.1 to 19.0% by weight of Tungsten (W) |
| 0.8 to 5.0% by weight of Vanadium (V), and |
| up to 8.0% by weight of Cobalt (Co) |

with the remainder comprising aluminum, nitrogen, iron, and impurity elements. In a first step, an alloy with the above composition, except for the element aluminum, may be melted and heated to a temperature of 80° C. to 250° C. above the liquidus temperature, deoxidized, and the melt surface in the ladle optionally is covered with a metallurgically active oxide-dissolving and nitride-dissolving slag. The slag may be melted, at least in the area in contact with the liquid steel, after which 0.4 to 1.4% by weight aluminum is added into the melt and distributed homogeneously therein. The steel melt is then stirred such that aluminum nitrides of the liquid steel with a diameter of greater than 38 μm are dissolved in the slag or are adjusted in the steel to a maximum diameter of 38 μm, and the nitrogen content thereof is reduced to below 0.012% by weight. In this manner magnesium is also introduced into the melt and allowed to react in the melt, an adjustment to a desired casting temperature, and subsequent casting of the melt to produce ingots takes place with a solidification thereof. Thereafter, a second step is carried out in which the ingot material is machined to produce objects in a desired tool shape. In a third step, a thermal hardening and tempering of the shaped tools is achieved with at least a single austenitization of the material at a temperature of below 1210° C. and at least one tempering in the temperature range of 500° C. to 600° C. Subsequently, a chipping of the machining allowance of the tool takes place.

Research as well as tests of the material have shown that in a liquid tool steel fully melted according to prior art, in particular in a high-speed steel, during alloying with aluminum in the furnace or in the ladle, coarse nitrides and oxides are formed, which inclusions continue to grow during solidification to form ingots and to form angular, coarse, nonmetallic particles that, upon further processing to produce tools, are oriented or inhomogeneously present in such a way as to influence the tool properties in a disadvantageous manner.

The advantages attained with the method according to the invention are now to be seen in that by means of the addition of aluminum, the nitrides and oxides formed in the liquid steel coagulate and can be removed. Further advantageously, in this manner the nitrogen content and the oxygen content of the melt are decisively reduced. It is important thereby that the actual temperature of the melt be at least 80° C. higher than the liquidus temperature in order to achieve a desired nitride, oxide, or oxynitride formation with aluminum. Overheating temperatures of the melt higher than 250° C., i.e., melt temperatures more than 250° C. higher than the liquidus temperature are unfavorable in terms of reaction kinetics and casting technology.

Aluminum additions up to 0.4% by weight cause a nitrogen setting and oxide formation in the liquid metal. Contents of aluminum above 0.4% by weight promote a coagulation of the nitrogen compounds as well as a coarsening of the oxides and in this manner a deposition into an active slag, so that advantageously only inclusions with a diameter of less than 38 μm remain in the steel. However, the prerequisite for this is a stirring of the melt in the ladle with a covering with active slag, which movement can be achieved according to the prior art by argon rinsing or by magnetic fields. In this manner according to the invention the nitrogen content of the steel can be reduced to below 0.02% by weight and the oxygen content to below 0.002% by weight.

Magnesium may also be introduced into the liquid steel in the process as described above. For example, magnesium may be introduced with the alloying of aluminum to the melt and a stirring thereof in the metallurgical vessel. Magnesium as a microalloying element on the one hand acts morphogenetically on the carbide precipitation and on the other hand acts on the formation of the composition of the non-metallic inclusions in the tool steel.

As was found, magnesium promotes the formation of monocarbides (MeC) in vanadium-containing tool steels even in low concentrations and thereby causes the amount of mixed carbides of the $Me_2C$, $Me_6C$ and of other carbides with a low proportion of carbon to be driven down. In other words: magnesium raises the carbon activity of monocarbide-forming elements in the alloy and in this manner causes a higher proportion of fine, hard monocarbides in the material, through which a wear resistance thereof is promoted. An increase in the strength with good toughness of the matrix can take place through mixed crystal formation.

With a further deoxidation and a desulfurization of the liquid steel, the introduced magnesium acts in a nucleating manner for a magnesium oxide-rich as well as a magnesium-rich mixed oxide final shaping and an oxysulfide formation (MgO, MgAlO, MgCaO, Mg(AlCa)O, MgOS), wherein a largely homogeneous distribution of nonmetallic inclusions of small size in the tool steel is achieved. Larger magnesium-rich reaction products in the steel melt can be removed by moving them into the slag.

Possible crucible reactions, as is known to the person skilled in the art, can be utilized by appropriate measures.

During a removal treatment of larger nitrides and/or oxides as well as oxynitrides and sulfides from the melt, it can be advantageous to add magnesium thereto and thereby to adjust a casting temperature of the steel in the ladle that is dependent on the melt composition.

A casting to produce ingots, advantageously under protective gas, and a further processing of the solidified ingots to produce tool raw material as well as the production of chip-removing tools essentially represent customary production steps.

An austenitization of the material at a temperature of below 1210° C. and at least one tempering of the hardened steel in the temperature range of 500° C. to 600° C. are advantageous production parameters.

In another embodiment of the invention, a tool material is provided that in practical use after a thermal hardening and tempering of a tool formed therefrom has a considerably increased service life thereof at the severest stresses. Such a tool, in particular a tool for a chip-removing machining of metallic materials, may be formed from an alloyed steel with a chemical composition in % by weight as follows:

| | |
|---|---|
| Carbon (C) | 0.7 to 1.3 |
| Silicon (Si) | 0.1 to 1.0 |
| Manganese (Mn) | 0.1 to 1.0 |
| Chromium (Cr) | 3.5 to 5.0 |
| Molybdenum (Mo) | 0.1 to 10.0 |
| Tungsten (W) | 0.1 to 19.0 |
| Vanadium (V) | 0.8 to 5.0 |
| Cobalt (Co) | up to 8.0 |
| Aluminum (Al) | 0.4 to 1.4 |
| Nitrogen (N) | 0.001 to 0.012 |

Iron (Fe) and production-caused impurities as remainder, which tool material has a hardness of greater than 66 HRC and a homogeneous distribution of nitride inclusions with a maximum diameter of less than 38 μm as well as magnesium-rich, nonmetallic inclusions of MgO, MgAlO, MgCaO, Mg(AlCa)O and MgOS with a maximum diameter of less than 10 μm.

Low nitrogen contents below 0.02% by weight as well as homogeneously distributed nitrides with a diameter of less than 38 μm increase the toughness of the material hardened and tempered to 66 HRC and largely prevent tool breakages or cutting edge chipped spots that can be caused by crack initiation of the edges by coarse nitrides.

An exact determination at room temperature of dissolved magnesium in a tool steel alloy appears to have not yet been solved scientifically. The presence of magnesium-rich, nonmetallic inclusions in the material, however, conveys the fact of an effect based on a certain solubility of magnesium in the steel at higher temperatures. Due to an aluminum content of 0.4 to 1.4% by weight, however, the dissolved oxygen and the like nitrogen must be bound in the tool steel in such a way that the introduced magnesium as an element intensifies a formation of monocarbide, in particular of vanadium carbide (VC), for which a hardness of approx. 3000 $HV_{0.02}$ was measured, and as a result this proportion of hard carbides is increased or the wear resistance of the tool is increased.

According to another embodiment of the invention, a tool is preferred in which the tool material has a content of

| |
|---|
| 0.5 to 1.3% by weight of Al and/or<br>0.005 to 0.01% by weight of N, |

nitrides with homogeneous distribution having a diameter of less than 36 μm and nonmetallic, magnesium-rich compounds having a maximum diameter of 8 μm or less.

The invention is explained in more detail below based on test results and research findings.

In a vacuum induction furnace a plurality of test alloys were melted and cast to produce ingots, from which test pieces were taken and drill tools were also produced according to the same technology.

With drills thermally hardened and tempered to a hardness of over 66 HRC, practical drill tests in which the maximum achievable service life of the tools was ascertained, were also carried out under severe operating conditions.

In order to represent the invention as far as possible uninfluenced by the activities of the alloying elements in interaction, three tool steels were selected with essentially the same composition, which composition can be gathered from Table 1.

The test alloys S 630 B, S 630 C and S 630 D were melted with selected scrap and pure raw materials. After a slag containing fluorspar was applied onto the melt, a deoxidizing and setting in motion of the melt took place with argon, in order to achieve a desired steel bath stirring, with an adjustment of the casting temperature.

After the desired casting temperature was adjusted, casting of the melt S 630 B to produce ingots took place.

The further test melts S 630 C and S 630 D were produced in the same manner, but alloyed with different amounts of aluminum, wherein and/or afterwards magnesium was introduced.

In principle an addition of magnesium to a slag can be carried out by immersion of magnesium components, for example, by inserting a filler wire or the like means and/or by a crucible reaction that is known to a person skilled in the art. We consider an immersion or insertion of magnesium into the liquid steel to be a safe technology and one to be preferred.

A casting of ingots was carried out as for the melt S 630 B.

An exact composition of the alloys being compared can be taken from Table 1. In a comparison of the respective concentrations of the elements in the test alloys, it is established that higher aluminum contents cause decisively lower oxygen and nitrogen concentrations in the steel.

Investigations concerning the existence and size of magnesium-rich nonmetallic inclusions were carried out on deformed sample parts of the stated alloys.

The tests were carried out with a scanning electron microscope:

REM model: JEOL JSM 6490 HV

EDX model: OXFORD INSTRUMENTSINCA-PENTAFET x3Si(Li) 30 $mm^2$

Software: INCA ENERGY/FEATURE with an evaluation according to ASTM E 2142.

As shown by the data from Table 2 concerning S 630 C and S 630 D, introducing magnesium into the melt causes a development of magnesium-rich nonmetallic inclusions, which furnishes the proof that at least at temperatures above the liquidus temperature of the alloy, small amounts of magnesium are soluble in the tool steel.

Metallographic examinations of the alloys S 630 B, S 630 C and S 630 D showed that an introduction of magnesium into the melt causes an increased proportion of monocarbide in the hardened and tempered material at the same concentration of carbon and the remaining carbide-forming alloy elements.

Figure 2:
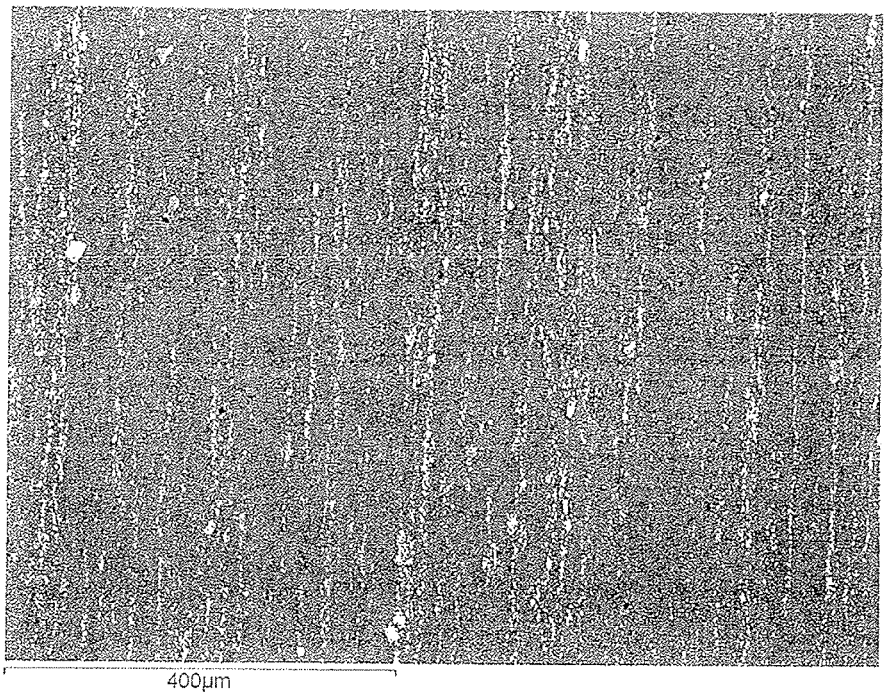
FIG. 2 shows the alloy S 630 C with magnesium treatment in the same representation.
Figure 3:
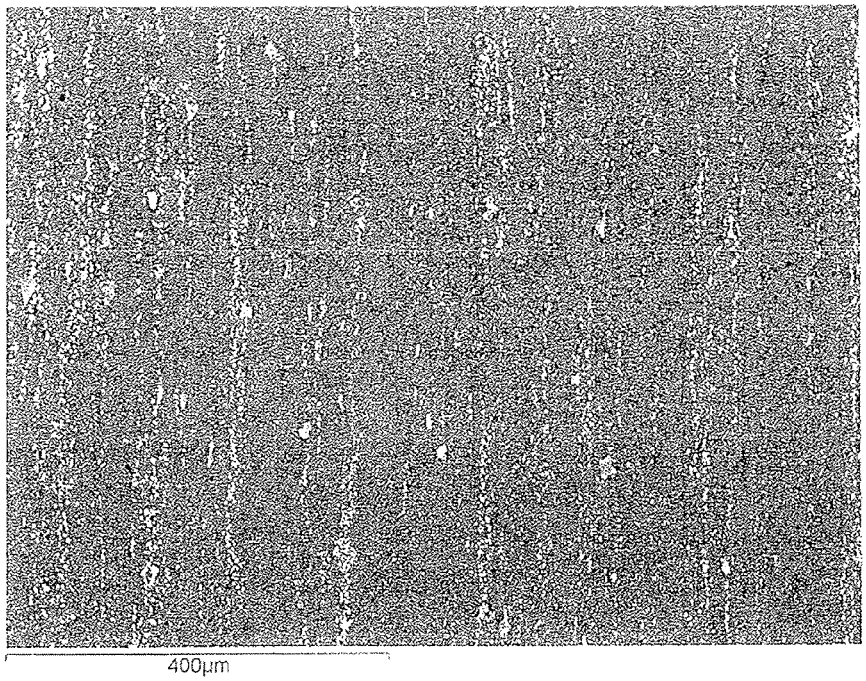
FIG. 3 shows the molten alloy S 630 D.

As can also be seen from the micrographs FIG. 1 through FIG. 3, the proportions of vanadium carbide in the Mg-treated tool steel are considerably increased. With thermally hardened and tempered samples from S 630 B (FIG. 1) when less than 0.8% by volume MeC-carbides, i.e. vanadium carbides, were ascertained at a volume proportion of over 3.3% by volume of $Me_6C$ carbides and acicular $Me_2C$ carbides, tests on the samples from the alloys S 630 C (FIG. 2) and S 630 D (FIG. 3) treated by magnesium additives yielded a vanadium-(monocarbide) proportion of over 3.0% by volume.

In FIGS. 1 through 3 the structural constituents can be ascertained based on the brightness hue of the areas. These are:

gray=matrix white=metal carbides of the $Me_6C$ type black=nonmetallic inclusions light grey=monocarbides (VC)

FIG. 1 shows the hardened and tempered alloy S 630 B in the etched micrograph, having a proportion of less than 0.8% by volume of vanadium carbide and a content of more than 3.3% by volume of $Me_2C$— and $Me_6C$ carbides.

Figure 1A:
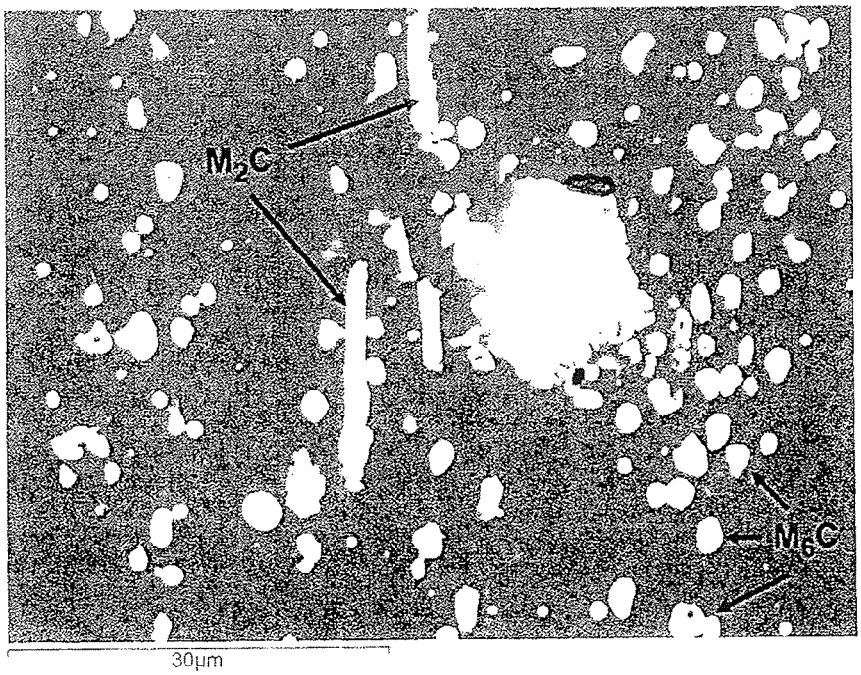
FIG. 1*a* shows a section of FIG. 1 at higher magnification.

FIG. 1*a* shows a section of FIG. 1 at higher magnification.

FIG. 2 shows the alloy S 630 C with magnesium treatment in the same representation, wherein the proportion of monocarbide or vanadium carbide is approx. 3.3% by volume and that of $Me_6C$ carbides of up to 2.8% by volume.

Figure 2A:
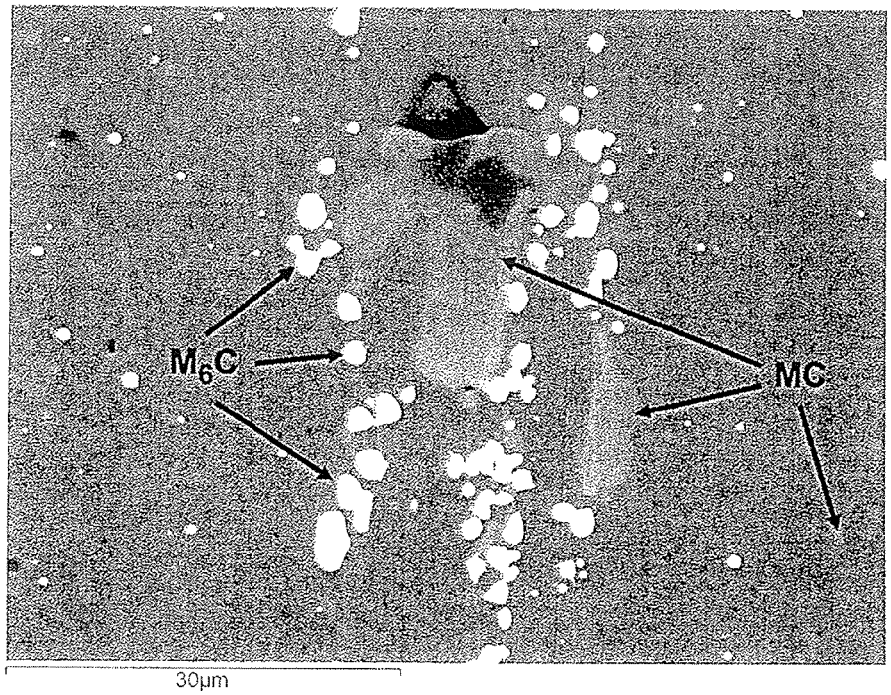
FIG. 2*a* shows an extensive lack of $Me_2C$ carbides at higher magnification.

FIG. 2*a* shows an extensive lack of $Me_2C$ carbides at higher magnification.

FIG. 3 shows the molten alloy S 630 D with addition of magnesium, which samples have an MeC carbide proportion of approx. 3.4% by volume and $Me_6C$ carbides in the amount of 2.7% by volume.

Figure 3A:
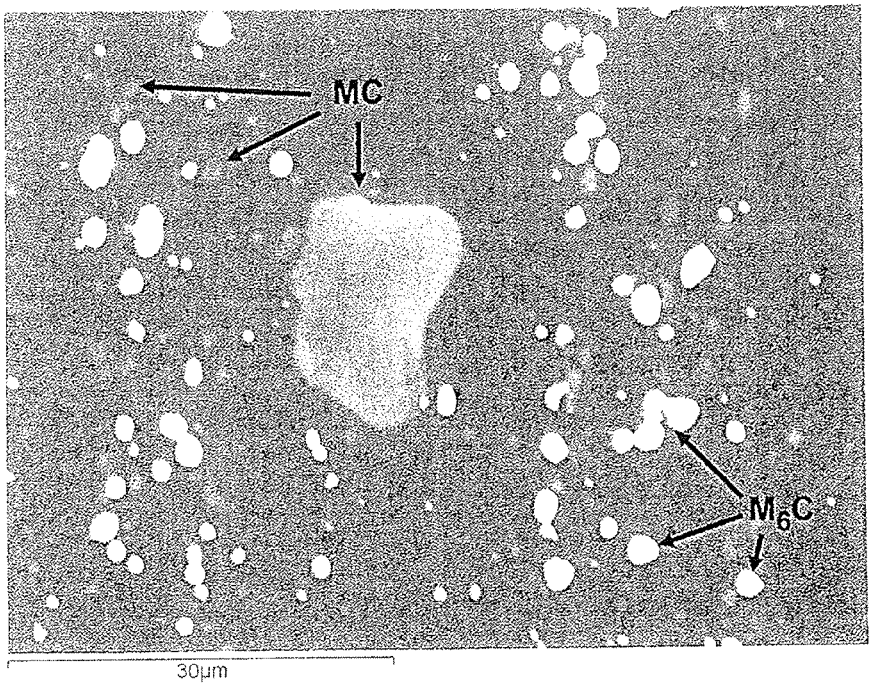
FIG. 3*a* shows a section of FIG. 3 at higher magnification.

FIG. 3*a* shows a section of FIG. 3 at higher magnification.

The structural proportions given are average values from 18 tests each.

By addition of magnesium to the material, an effect of higher proportions of MeC type carbides with high hardness at reduced proportions of carbides of the $Me_6C$ type and in particular of the $Me_2C$ type as well as carbides having further lower carbon proportions on the performance of chip-removing tools was ascertained by means of drill performance tests.

With drills produced from the materials according to designations S 630 B, S 630 C and S 630 D, hollows with a diameter of 6 mm were made in a 42 CrMo4 material at a speed of 12 m/min and a drill penetration advance of 0.08 mm/revolution.

The performance values in % of the drills made from the respective alloys are average values from 18 tests each, wherein the performance of the drills from the S 630 B material was determined as a base value at 100%.

Drills made of the material S 630 C produced a drill performance of 210%, wherein a performance of 240% could be achieved with drills made of the material S 630 D.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

TABLE 1

| | C | Al | O | Cr | Mo | V | W | Si | N | Co |
|---|---|---|---|---|---|---|---|---|---|---|
| S630B | 0.96 | 0.03 | 0.0022 | 4.29 | 4.02 | 1.96 | 3.98 | 0.400 | 0.027 | 0.370 |
| S630C | 0.96 | 0.53 | 0.00090 | 4.27 | 3.98 | 1.93 | 3.94 | 0.420 | 0.018 | 0.360 |
| S630D | 0.96 | 1.07 | 0.0016 | 3.95 | 4.07 | 1.94 | 3.95 | 0.430 | 0.012 | 0.320 |
| | Mn | Zr | P | S | Cu | As | Ti | Nb | B | Ni |
| S630B | 0.300 | <0.005 | 0.025 | 0.0012 | 0.150 | 0.008 | 0.007 | <0.005 | <0.0005 | 0.320 |
| S630C | 0.340 | <0.005 | 0.024 | 0.0009 | 0.140 | 0.008 | 0.017 | 0.006 | 0.001 | 0.280 |
| S630D | 0.310 | <0.005 | 0.022 | 0.0007 | 0.120 | 0.007 | 0.011 | 0.005 | 0.001 | 0.260 |

TABLE 2

| | S630B, | | S630C, | | S630D, | |
|---|---|---|---|---|---|---|
| | Ø Width (μm) | Ø Length (μm) | Ø Width (μm) | Ø Length (μm) | Ø Width (μm) | Ø Length (μm) |
| MgO | — | — | 1.67 | 2.41 | 1.62 | 2.25 |
| MgAlO | — | — | 2.24 | 3.75 | 1.50 | 2.05 |
| MgCaO | — | — | 1.37 | 2.04 | 1.64 | 2.28 |
| Mg—(Al,Ca)O | — | — | 2.73 | 4.27 | 3.72 | 5.80 |
| Mg—OS | — | — | 1.73 | 2.50 | 1.52 | 2.07 |

The invention claimed is:

1. A tool for a chip-removing machining of metallic materials formed from an alloyed steel with a chemical composition comprising:

0.7 to 1.3% by weight of Carbon (C)
0.1 to 1.0% by weight of Silicon (Si)
0.1 to 1.0% by weight of Manganese (Mn)
3.5 to 5.0% by weight of Chromium (Cr)
0.1 to 10.0% by weight of Molybdenum (Mo)
0.1 to 19.0% by weight of Tungsten (W)
0.8 to 5.0% by weight of Vanadium (V)
up to 8.0% by weight of Cobalt (Co)
0.4 to 1.4% by weight of Aluminum (Al)
0.001 to 0.02% by weight of Nitrogen (N)

as well as Iron (Fe) and production-caused impurities, which tool material has a hardness of greater than 66 HRC and a homogeneous distribution of nitrides with a maximum diameter of less than 38 μm as well as magnesium-rich, nonmetallic inclusions of MgO, MgAlO, MgCaO, Mg(AlCa)O and MgOS with a maximum diameter of less than 10 μm.

2. A tool according to claim 1, in which the tool material has 0.5 to 1.3% by weight of A1 and/or 0.005 to 0.02% by weight of N, the nitrides with homogeneous distribution have a diameter of less than 34 μm, and the nonmetallic, magnesium-rich inclusions have a maximum diameter of 8 μm or less.

3. A method for the production of tools for a chip-removing machining of metallic materials, formed from an alloyed steel comprising 0.7 to 1.3% by weight of Carbon (C)
0.1 to 1.0% by weight of Silicon (Si)
0.1 to 1.0% by weight of Manganese (Mn)
3.5 to 5.0% by weight of Chromium (Cr)

-continued

| |
|---|
| 0.1 to 10.0% by weight of Molybdenum (Mo) |
| 0.1 to 19.0% by weight of Tungsten (W) |
| 0.8 to 5.0% by weight of Vanadium (V), and |
| up to 8.0% by weight of Cobalt (Co) |

as well as aluminum, nitrogen, and iron, wherein said method comprises:

melting an alloy with the above composition, except for the element aluminum, and heating the alloy to a temperature of 80° C. to 250° C. above the liquidus temperature and deoxidizing the alloy to produce a steel melt;

optionally covering the melt surface with a metallurgically active oxides-dissolving and nitrides-dissolving slag wherein the slag is at least partially melted;

adding 0.4 to 1.4% by weight aluminum into the melt such that the aluminum is distributed homogeneously therein;

stirring the melt so that aluminum nitrides of liquid steel are dissolved in the slag or are adjusted in the steel to a maximum diameter of 38 μm, and the nitrogen content thereof is reduced to below 0.02% by weight;

introducing magnesium into the melt and allowing it to react in the melt;

adjusting the melt to a desired casting temperature, and casting it to produce an ingot;

machining the ingot to produce an object in a desired tool shape;

thermal hardening the shaped tool with a single austenitization at a temperature below 1210° C.;

tempering the shaped tool at a temperature of 500° C. to 600° C.; and chipping the machining allowance of the tool.

4. The method according to claim 3, in which the aluminum is at a concentration of 0.4 to 1.3% by weight and is alloyed to the deoxidized melt; and the maximum size of the aluminum nitrides is adjusted to a diameter of 34 μm and a the nitrogen content of the steel is reduced to less than 0.02% by weight.

5. The method according to claim 3, wherein magnesium is added to the melt at and/or after alloying with aluminum takes place such that magnesium-rich, nonmetallic inclusions of MgO, MgAlO, MgCaO, Mg(AlCa)O and MgOS having a maximum diameter of 10 μm are formed.

6. The method according to claim 5, wherein the inclusions have a maximum diameter of 8 μm.

7. The method according to claim 3, wherein austenitization of the shaped tool occurs at a temperature of 1200° C. with a dwell period thereat of maximum 15 minutes.

8. The method according to claim 3, wherein austenitization of the shaped tool occurs at a maximum temperature of 1160° C. with a dwell period thereat of maximum 15 minutes.

9. A tool for the chip-removing machining of metallic materials made by the method of claim 3.

10. A method for the production of an ingot formed from an alloyed steel comprising

| |
|---|
| 0.7 to 1.3% by weight of Carbon (C) |
| 0.1 to 1.0% by weight of Silicon (Si) |
| 0.1 to 1.0% by weight of Manganese (Mn) |
| 3.5 to 5.0% by weight of Chromium (Cr) |
| 0.1 to 10.0% by weight of Molybdenum (Mo) |
| 0.1 to 19.0% by weight of Tungsten (W) |
| 0.8 to 5.0% by weight of Vanadium (V), and |
| up to 8.0% by weight of Cobalt (Co) |

as well as aluminum, nitrogen, and iron, wherein said method comprises:

melting an alloy with the above composition, except for the element aluminum, and heating the alloy to a temperature of 80° C. to 250° C. above the liquidus temperature and deoxidizing the alloy to produce a steel melt;

optionally, covering the melt surface with a metallurgically active oxides-dissolving and nitrides-dissolving slag wherein the slag is at least partially melted;

adding 0.4 to 1.4% by weight aluminum into the melt and distributing the aluminum homogeneously therein;

stirring the melt so that aluminum nitrides of liquid steel are dissolved in the slag or are adjusted in the steel to a maximum diameter of 38 μm, and the nitrogen content thereof is reduced to below 0.02% by weight;

introducing magnesium into the melt and allowing the magnesium to react in the melt;

adjusting the melt to a desired casting temperature, and casting the melt to produce an ingot.

11. The method according to claim 10, further comprising:

machining the ingot to produce an object in a desired tool shape;

thermal hardening the shaped tool with a single austenitization at a temperature below 1210° C.; and tempering the shaped tool at a temperature of 500° C. to 600° C.

12. An ingot produced by the method of claim 10.

* * * * *